US009243506B2

(12) United States Patent
McMahan et al.

(10) Patent No.: US 9,243,506 B2
(45) Date of Patent: Jan. 26, 2016

(54) METHODS AND SYSTEMS FOR COOLING A TRANSITION NOZZLE

(75) Inventors: Kevin Weston McMahan, Greer, SC (US); Ronald James Chila, Greenfield Center, NY (US); David Richard Johns, Greenville, SC (US)

(73) Assignee: General Electric Company, Schenectady, NY (US)

( * ) Notice: Subject to any disclaimer, the term of this patent is extended or adjusted under 35 U.S.C. 154(b) by 955 days.

(21) Appl. No.: 13/342,475

(22) Filed: Jan. 3, 2012

(65) Prior Publication Data

US 2013/0167543 A1 Jul. 4, 2013

(51) Int. Cl.

| | |
|---|---|
| ***F23R 3/44*** | (2006.01) |
| ***F01D 9/02*** | (2006.01) |
| *F23R 3/00* | (2006.01) |
| *F01D 25/12* | (2006.01) |
| *F23R 3/04* | (2006.01) |
| *F23R 3/34* | (2006.01) |

(52) U.S. Cl.

CPC ..... *F01D 9/023* (2013.01); *F01D 25/12* (2013.01); *F05D 2260/2322* (2013.01); *F23R 3/002* (2013.01); *F23R 3/005* (2013.01); *F23R 3/04* (2013.01); *F23R 3/34* (2013.01); *F23R 2900/03043* (2013.01); *F23R 2900/03341* (2013.01)

(58) Field of Classification Search

CPC ..... F23R 3/002; F23R 3/005; F23R 2900/03043; F01D 9/023

USPC ..... 60/752–760

See application file for complete search history.

(56) References Cited

U.S. PATENT DOCUMENTS

| | | | | | |
|---|---|---|---|---|---|
| 2,910,828 | A | * | 11/1959 | Meyer et al. | 60/266 |
| 3,344,606 | A | * | 10/1967 | Abernethy | 60/241 |
| 3,584,972 | A | * | 6/1971 | Bratkovich et al. | 416/229 R |
| 4,195,474 | A | * | 4/1980 | Bintz et al. | 60/39.37 |
| 4,314,442 | A | * | 2/1982 | Rice | 60/775 |
| 4,437,418 | A | * | 3/1984 | Guillaume et al. | 110/246 |
| 4,507,914 | A | * | 4/1985 | Rice | 60/39.17 |
| 4,543,781 | A | * | 10/1985 | Rice | 60/804 |
| 4,928,478 | A | * | 5/1990 | Maslak | 60/775 |
| 5,724,816 | A | * | 3/1998 | Ritter et al. | 60/752 |
| 5,933,699 | A | * | 8/1999 | Ritter et al. | 419/6 |
| 6,341,485 | B1 | * | 1/2002 | Liebe | 60/772 |

(Continued)

FOREIGN PATENT DOCUMENTS

| | | | |
|---|---|---|---|
| CN | 101307723 | A | 11/2008 |
| CN | 101799029 | A | 8/2010 |

(Continued)

OTHER PUBLICATIONS

China Office Action for related Application No. 201310003291.5 dated Oct. 29, 2015; 13 pages.

*Primary Examiner* — William H Rodriguez
*Assistant Examiner* — Lorne Meade
(74) *Attorney, Agent, or Firm* — Armstrong Teasdale LLP

(57) ABSTRACT

A transition nozzle for use with a turbine assembly is provided. The transition nozzle includes a liner defining a combustion chamber therein, a wrapper circumscribing the liner such that a cooling duct is defined between the wrapper and the liner, a cooling fluid inlet configured to supply a cooling fluid to the cooling duct, and a plurality of ribs coupled between the liner and the wrapper such that a plurality of cooling channels are defined in the cooling duct.

11 Claims, 6 Drawing Sheets

(56) References Cited

U.S. PATENT DOCUMENTS

| | | | | |
|---|---|---|---|---|
| 6,463,742 | B2 * | 10/2002 | Mandai et al. | 60/806 |
| 6,772,581 | B2 | 8/2004 | Ojiro et al. | |
| 6,890,148 | B2 | 5/2005 | Nordlund | |
| 7,310,938 | B2 * | 12/2007 | Marcum et al. | 60/39.37 |
| 7,401,682 | B2 * | 7/2008 | Proscia et al. | 181/290 |
| 7,827,801 | B2 * | 11/2010 | Dawson et al. | 60/759 |
| 8,727,714 | B2 * | 5/2014 | Snider et al. | 415/178 |
| 2006/0130484 | A1 | 6/2006 | Marcum et al. | |
| 2010/0316492 | A1 * | 12/2010 | Charron et al. | 415/182.1 |
| 2012/0121381 | A1 * | 5/2012 | Charron et al. | 415/115 |
| 2012/0121408 | A1 * | 5/2012 | Lee et al. | 415/214.1 |

FOREIGN PATENT DOCUMENTS

| | | | |
|---|---|---|---|
| CN | 101832555 | A | 9/2010 |
| CN | 102562309 | A | 7/2012 |
| EP | 1143201 | A2 | 10/2001 |

* cited by examiner

METHODS AND SYSTEMS FOR COOLING A TRANSITION NOZZLE

BACKGROUND

The present disclosure relates generally to turbine systems and, more particularly, to cooling transition nozzles that may be used with a turbine system.

At least some known gas turbine systems include a combustor that is distinct and separate from a turbine. During operation, some such turbine systems may develop leakages between the combustor and the turbine that may impact the emissions capability (i.e., NOx) of the combustor and/or may decrease the performance and/or efficiency of the turbine system.

To reduce such leakages, at least some known turbine systems include a plurality of seals between the combustor and the turbine. Over time, however, operating at increased temperatures may weaken the seals between the combustor and turbine. Maintaining such seals may be tedious, time-consuming, and/or cost-inefficient.

Additionally or alternatively, to increase emissions capability, at least some known turbine systems increase an operating temperature of the combustor. For example, flame temperatures within some known combustors may be increased to temperatures in excess of about 3900° F. However, increased operating temperatures may adversely limit a useful life of the combustor and/or turbine system.

BRIEF DESCRIPTION

In one aspect, a transition nozzle for use with a turbine assembly is provided. The transition nozzle includes a liner defining a combustion chamber therein, a wrapper circumscribing the liner such that a cooling duct is defined between the wrapper and the liner, a cooling fluid inlet configured to supply a cooling fluid to the cooling duct, and a plurality of ribs coupled between the liner and the wrapper such that a plurality of cooling channels are defined in the cooling duct.

In another aspect, a turbine assembly is provided. The turbine assembly includes a fuel nozzle configured to mix fuel and air to create a fuel and air mixture, and a transition nozzle oriented to receive the fuel and air mixture from the fuel nozzle. The transition nozzle includes a liner defining a combustion chamber therein, a wrapper circumscribing the liner such that a cooling duct is defined between the wrapper and the liner, a cooling fluid inlet configured to supply a cooling fluid to the cooling duct, and a plurality of ribs coupled between the liner and the wrapper such that a plurality of cooling channels are defined in the cooling duct.

In yet another aspect, a method of assembling a turbine assembly is provided. The method includes coupling a fuel nozzle to a transition nozzle, the transition nozzle including a liner defining a combustion chamber therein and a wrapper circumscribing the liner such that a cooling duct is defined between the wrapper and the liner, coupling a cooling fluid source in flow communication with a cooling fluid inlet configured to supply a cooling fluid to the cooling duct, and coupling a plurality of ribs between the liner and the wrapper such that a plurality of cooling channels are defined in the cooling duct.

The features, functions, and advantages described herein may be achieved independently in various embodiments of the present disclosure or may be combined in yet other embodiments, further details of which may be seen with reference to the following description and drawings.

DETAILED DESCRIPTION

The systems and methods described herein facilitate cooling a transition nozzle. The transition nozzle includes a cooling duct defined between a liner and a wrapper. A cooling fluid source supplies a cooling fluid, such as steam, to the cooling duct. A plurality of ribs coupled between the liner and the wrapper define a plurality of cooling channels in the wrapper. As the cooling fluid flows through the cooling channels, it facilitates cooling the transition nozzle.

As used herein, the terms "axial" and "axially" refer to directions and orientations extending substantially parallel to a longitudinal axis of a combustor. As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
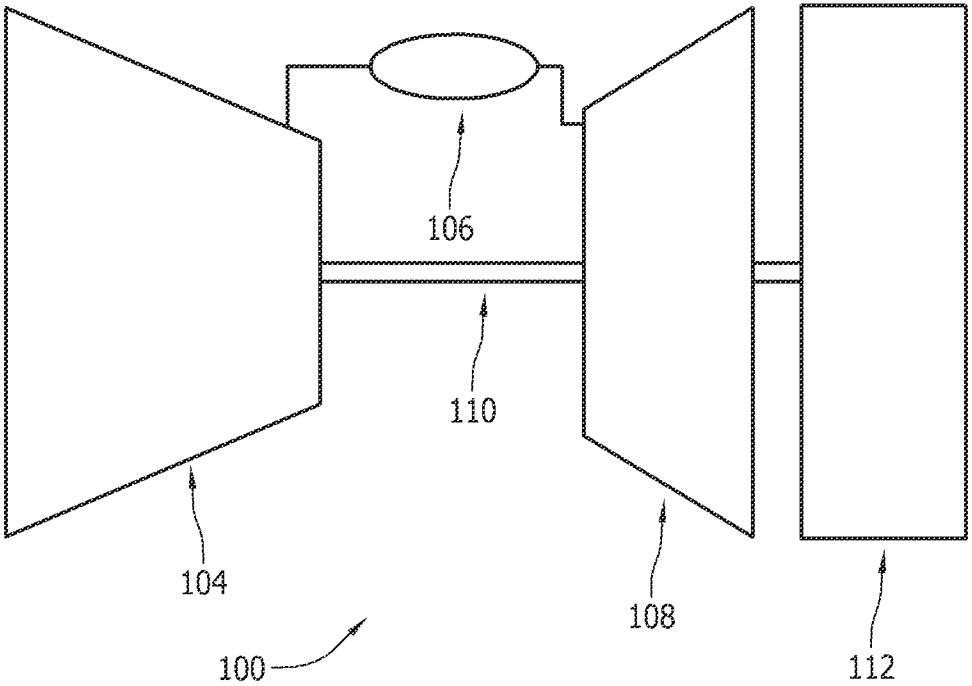
FIG. 1 is a schematic illustration of an exemplary turbine assembly.

FIG. 1 is a schematic illustration of an exemplary turbine assembly 100. In the exemplary embodiment, turbine assembly 100 includes, coupled in a serial flow arrangement, a compressor 104, a combustor assembly 106, and a turbine 108 that is rotatably coupled to compressor 104 via a rotor shaft 110.

During operation, in the exemplary embodiment, ambient air is channeled through an air inlet (not shown) towards compressor 104. The ambient air is compressed by compressor 104 prior it to being directed towards combustor assembly 106. In the exemplary embodiment, compressed air is mixed with fuel, and the resulting fuel-air mixture is ignited within combustor assembly 106 to generate combustion gases that are directed towards turbine 108. Moreover, in the exemplary embodiment, turbine 108 extracts rotational energy from the combustion gases and rotates rotor shaft 110 to drive compressor 104. Furthermore, in the exemplary embodiment, turbine assembly 100 drives a load 112, such as a generator, coupled to rotor shaft 110. In the exemplary embodiment, load 112 is downstream of turbine assembly 100. Alternatively, load 112 may be upstream from turbine assembly 100.

Figure 2:
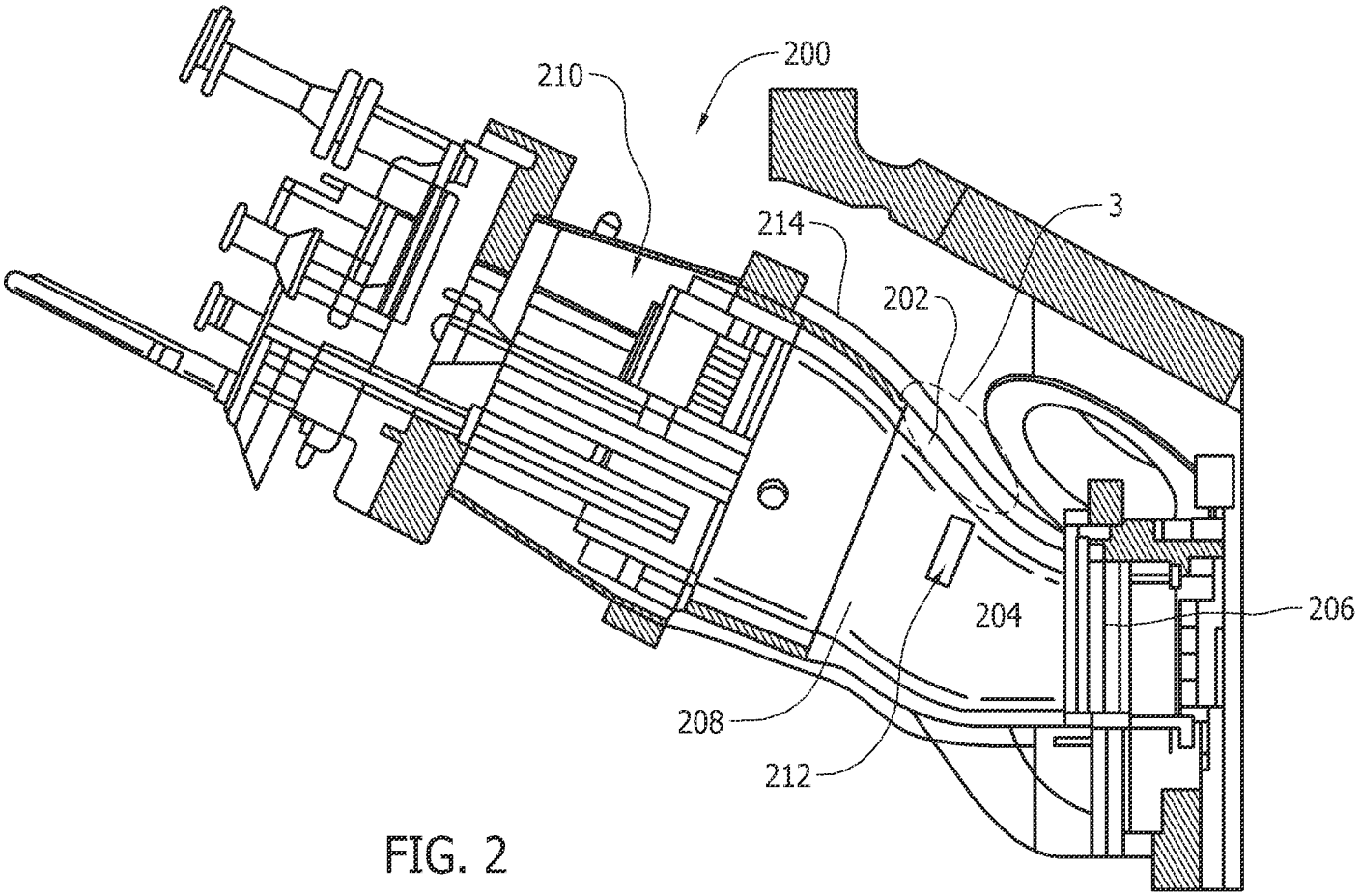
FIG. 2 is a cross-sectional view of an exemplary transition nozzle that may be used with the turbine assembly shown in FIG. 1.

FIG. 2 is a cross-sectional view of an exemplary transition nozzle 200 that may be used with turbine assembly 100. In the exemplary embodiment, transition nozzle 200 has a central axis that is substantially linear. Alternatively, transition nozzle 200 may have a central axis that is canted. Transition nozzle 200 may have any size, shape, and/or orientation suitable to enable transition nozzle 200 to function as described herein.

In the exemplary embodiment, transition nozzle 200 includes a combustion liner portion 202, a transition portion 204, and a turbine nozzle portion 206. In the exemplary embodiment, at least transition portion 204 and nozzle portion 206 are integrated into a single, or unitary, component. Further, liner portion 202, transition portion 204, and nozzle portion 206 may all be integrated into a single, or unitary, component. For example, in one embodiment, transition nozzle 200 is cast and/or forged as a single piece.

In the exemplary embodiment, liner portion 202 defines a combustion chamber 208 therein. More specifically, in the exemplary embodiment, liner portion 202 is oriented to receive fuel and/or air at a plurality of different locations (not shown) spaced along an axial length of liner portion 202 to enable fuel flow to be locally controlled for each combustor (not shown) of combustor assembly 106. Thus, localized control of each combustor facilitates combustor assembly 106 to operate with a substantially uniform fuel-to-air ratio within combustion chamber 208. For example, in the exemplary embodiment, liner portion 202 receives a fuel and air mixture from at least one fuel nozzle 210 and receives fuel from a second stage fuel injector 212 that is downstream from fuel nozzle 210. In another embodiment, a plurality of individually-controllable nozzles are spaced along the axial length of liner portion 202. Alternatively, the fuel and air may be mixed within chamber 208.

In the exemplary embodiment, the fuel and air mixture is ignited within chamber 208 to generate hot combustion gases. In the exemplary embodiment, transition portion 204 is oriented to channel the hot combustion gases downstream towards nozzle portion 206. In one embodiment, transition portion 204 includes a throttled end (not shown) that is oriented to channel hot combustion gases at a desired angle towards a turbine bucket (not shown). In such an embodiment, the throttled end functions as a nozzle. Additionally or alternatively, transition portion 204 may include an extended shroud (not shown) that substantially circumscribes the nozzle in an orientation that enables the extended shroud and the nozzle to direct the hot combustion gases at a desired angle towards the turbine bucket. A wrapper 214 circumscribes liner portion 202. In the exemplary embodiment, wrapper 214 is metal. Alternatively, wrapper 214 may be manufactured from any material that enables transition nozzle 200 to function as described herein.

Figure 3:
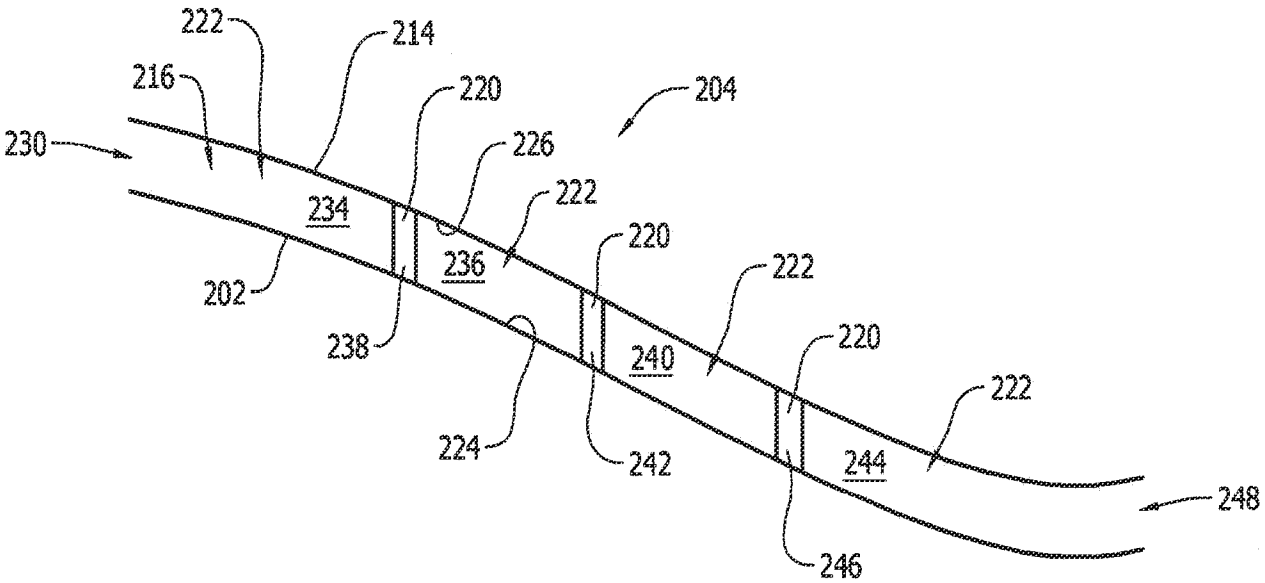
FIG. 3 is a schematic cross-sectional view of a portion of the transition nozzle shown in FIG. 2 and taken within area 3.
Figure 4:
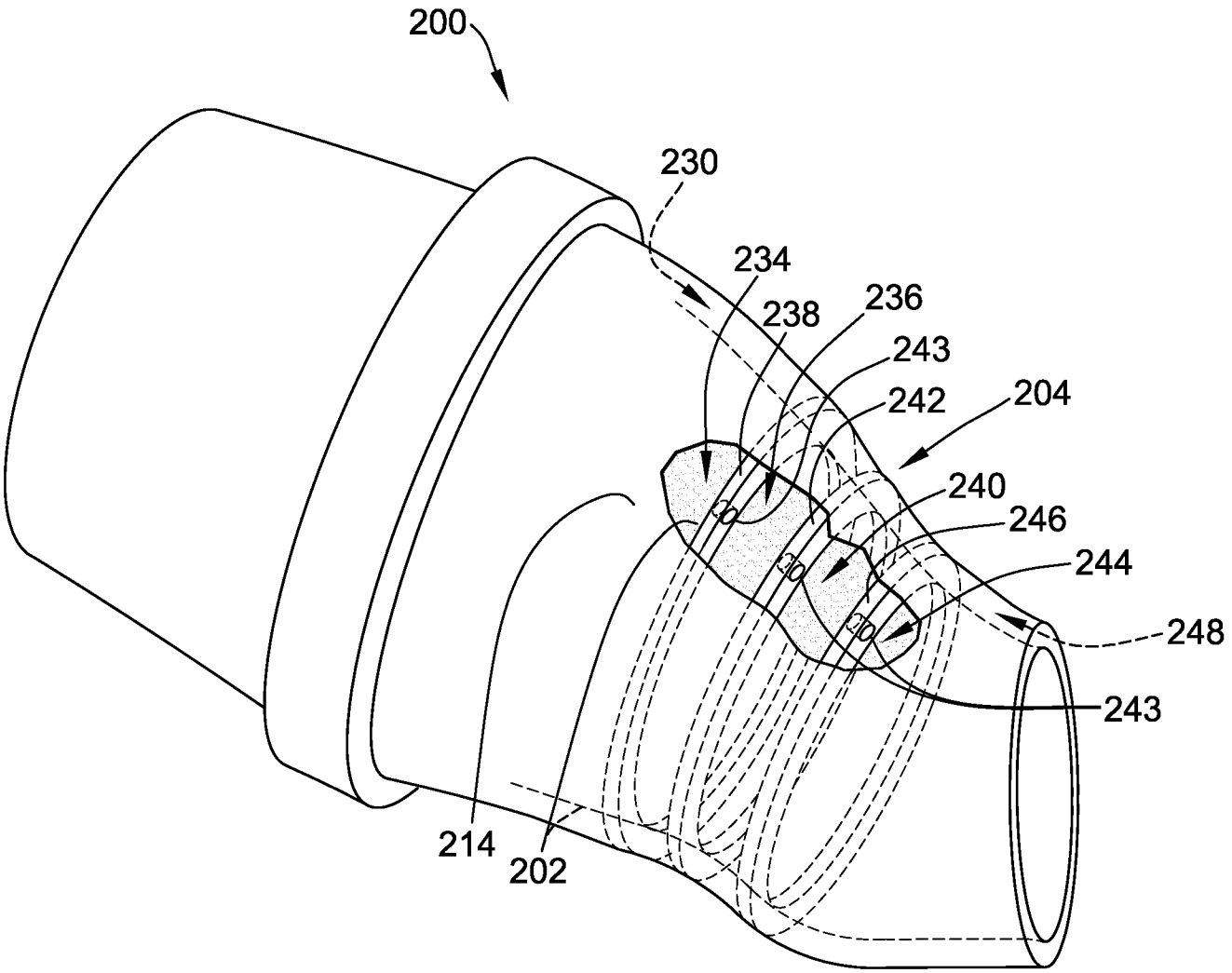
FIG. 4 is a perspective cutaway view of the transition nozzle portion shown in FIG. 3.

FIGS. 3 and 4 are schematic cross-sectional and perspective cutaway views, respectively, of a portion of transition nozzle 200 taken along area 3 (shown in FIG. 2). A cooling duct 216 is defined between wrapper 214 and liner portion 202. In the exemplary embodiment, a plurality of ribs 220 extend between wrapper 214 and liner portion 202 to define a plurality of cooling channels 222 in cooling duct 216. Specifically, ribs 220 extend between a radially outer surface 224 of liner portion 202 and a radially inner surface 226 of wrapper 214. Ribs 220 may be coupled to radially outer surface 224 and radially inner surface 226 using any suitable methods. For example, in some embodiments, ribs 220 may be welded to radially outer surface 224 and radially inner surface 226. Alternatively, ribs 220 may be cast and/or integrally formed with at least one of liner portion 202 and wrapper 214.

A cooling fluid inlet 230 supplies cooling fluid to cooling duct 216. In the exemplary embodiment, the cooling fluid is steam. Alternatively, the cooling fluid is any fluid that facilitates cooling of transition portion 204. For example, in some embodiments, cooling fluid is liquid water. The cooling fluid facilitates cooling liner portion 202 and wrapper 214 as it flows through cooling duct 216.

In the exemplary embodiment, ribs 220 extend circumferentially around cooling duct 216 such that cooling channels 222 are axially spaced. A first cooling channel 234 in flow communication with cooling fluid inlet 230 is separated axially from a second cooling channel 236 by a first rib 238. Similarly, second cooling channel 236 is separated axially from a third cooling channel 240 by a second rib 242, and third cooling channel 240 is separated axially from a fourth cooling channel 244 by a third rib 246. Fourth cooling channel 244 is in flow communication with a cooling fluid outlet 248.

Although cooling channels 234, 236, 240, and 244 are axially separated from one another, cooling channels 234, 236, 240, and 244 are in flow communication with one another circumferentially. That is, first cooling channel 234 is in flow communication with second cooling channel 236, second cooling channel 236 is in flow communication with third cooling channel 240, and third cooling channel is in flow communication with fourth cooling channel 244. Further, first rib 238 is coupled to second rib 242, and second rib 242 is coupled to third rib 246. Accordingly, in the exemplary embodiment cooling duct 216 has a spiral-shaped configuration that wraps around liner portion 202.

Alternatively, in some embodiments, first cooling channel 234, second cooling channel 236, third cooling channel 240, and fourth cooling channel 244 are not in flow communication. In such embodiments, each cooling channel 234, 236, 240, and 244 has an individual cooling fluid inlet and outlet (neither shown). Notably, cooling channels 234, 236, 240, and 244 may have any configuration of fluid communication between one another that enables cooling duct 216 to function as described herein, with all, none, or only a portion of cooling channels 234, 236, 240, and 244 being in flow communication with one another (e.g., each pair of adjacent cooling channels 234, 236, 240, and 244 may be in flow communication via a respective communication port 243).

While cooling duct 216 includes three ribs 220 and four cooling channels 222 in the exemplary embodiment, cooling duct 216 may include any number of ribs and/or cooling channels that enable cooling duct 216 to function as described herein. Cooling channels 234, 236, 240, and 244 may also include one or more surface enhancements (not shown), such as turbulators, dimples, and/or fins. The surface enhancements may have any geometry, orientation, and/or configuration that further facilitates cooling transition portion 204. For example, cooling channels 234, 236, 240, and 244 may include chevron-shaped, slanted, and/or straight turbulators.

Figure 5:
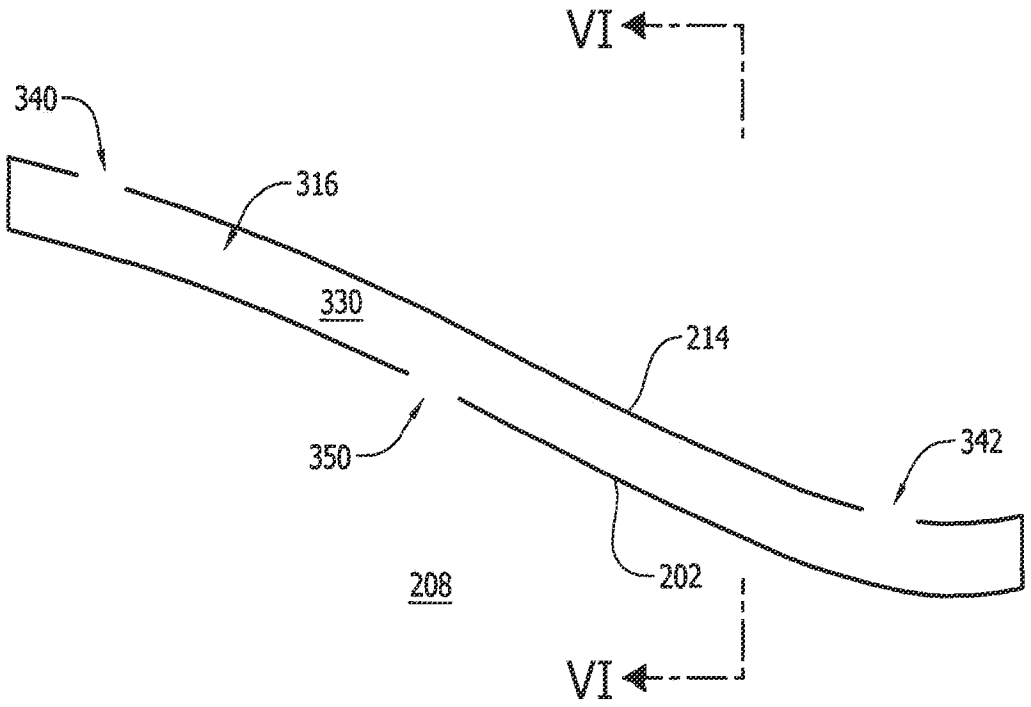
FIG. 5 is a schematic cross-sectional view of a portion of an alternative cooling duct that may be used with the transition nozzle shown in FIG. 2.
Figure 6:
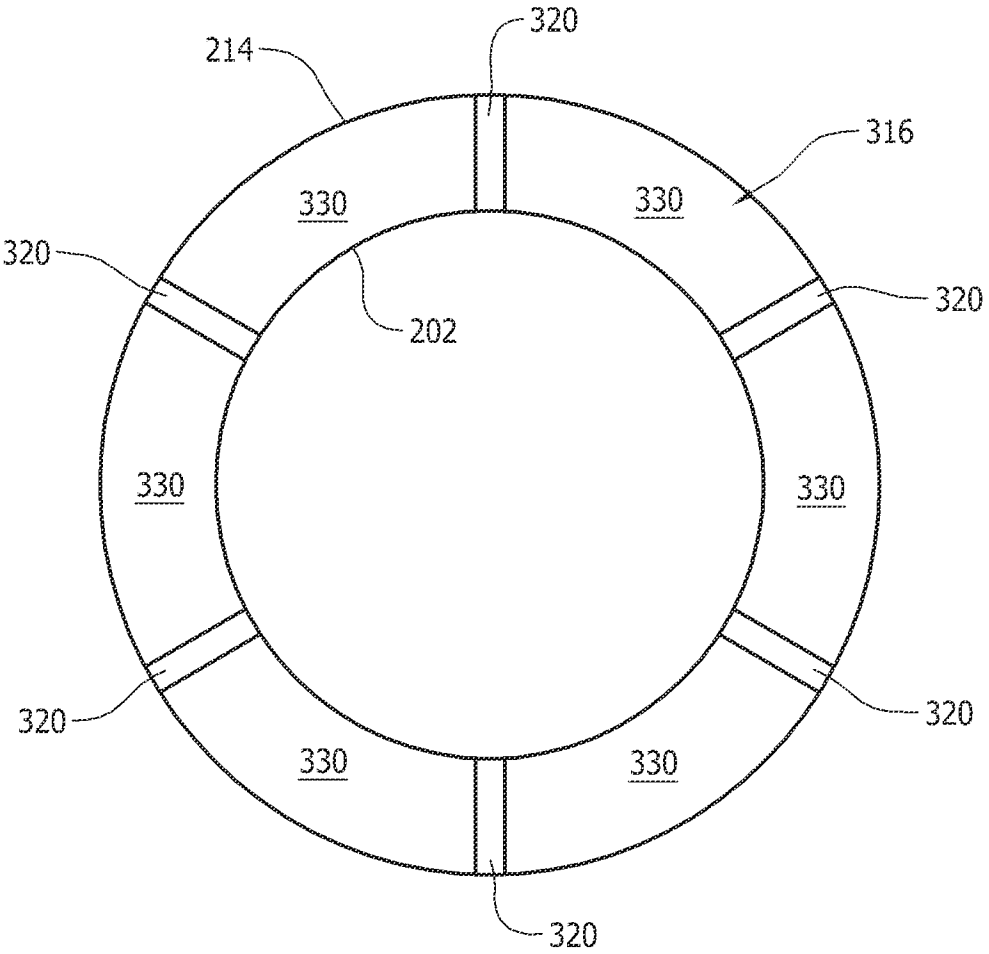
FIG. 6 is a schematic cross-sectional view of the portion of the cooling duct shown in FIG. 5 and taken along plane VI-VI of FIG. 5.

FIG. 5 is a schematic cross-sectional view of a portion of an alternative cooling duct 316 that may be used with transition nozzle 200 (shown in FIG. 2). FIG. 6 is a schematic cross-sectional view of the portion of cooling duct 316 shown in FIG. 5 and taken along plane VI-VI of FIG. 5. Unless otherwise specified, cooling duct 316 is substantially similar to cooling duct 216 (shown in FIG. 3), and similar components are labeled in FIG. 5 with the same reference numerals used in FIG. 3. A plurality of ribs 320 are coupled between liner portion 202 and wrapper 214. Ribs 320 extend axially along transition portion 204. Accordingly, ribs 320 separate cooling duct 316 into a plurality of axially extending cooling channels 330 that are separated circumferentially.

In the exemplary embodiment, each cooling channel 330 includes a cooling fluid inlet 340 and a cooling fluid outlet 342 defined in wrapper 214. Cooling fluid flows from a cooling fluid source (not shown) through inlet 340 into cooling channel 330. As cooling fluid flows through cooling channels 330, cooling fluid facilitates cooling liner portion 202 and wrapper 214.

While an exemplary cooling channel 330 is shown in FIG. 3, alternatively, other cooling channel configurations may be utilized. For example, in one embodiment, a plurality of cooling channels are independent from one another (i.e., not in fluid communication with one another). In such an embodiment, the flow of cooling fluid to individual cooling channels may be controlled, such that cooling fluid can be selectively channeled to a subset of the independent cooling channels. Accordingly, by selecting which cooling channels receive cooling fluid, different portions and/or components of transition nozzle 200 may be selectively cooled.

At least one cooling channel 330 includes a cooling aperture 350 defined in liner portion 202. Accordingly at least a portion of cooling fluid flows through cooling aperture 350 into combustion chamber 208. While cooling duct 316 includes six ribs 320 and six cooling channels 330 in the exemplary embodiment, cooling duct 316 may include any number of ribs and/or cooling channels that enable cooling duct 316 to function as described herein.

The configuration of the ribs and cooling channels are not limited to the specific embodiments described herein. For example, the cooling channels are not limited to spiral channels and axially extending channels, but may include, for example, sinusoidal-shaped channels. Further, the ribs may have any suitable dimensions, spacing, and/or orientation that enable the cooling fluid to facilitate cooling components of a transition portion.

The embodiments described herein facilitate cooling a transition nozzle. The transition nozzle includes a cooling duct defined between a liner and a wrapper. A cooling fluid source supplies a cooling fluid, such as steam, to the cooling duct. A plurality of ribs coupled between the liner and the wrapper define a plurality of cooling channels in the wrapper. As the cooling fluid flows through the cooling channels, it facilitates cooling the transition nozzle.

As compared to at least some known turbine assemblies, the methods and systems described herein facilitate increased cooling of a transition nozzle. Cooling fluid flows through a plurality of cooling channels defined between a liner and a wrapper by a plurality of ribs. As the cooling fluid flows through the cooling channels, it cools components of the turbine assembly. The position and orientation of the ribs may be adjusted to create different cooling configurations, providing a more flexible cooling system than those included in at least some known turbine assemblies.

The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the invention, including the best mode, and also to enable any person skilled in the art to practice those certain embodiments, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of assembling a turbine assembly comprising:

coupling a fuel nozzle to a transition nozzle, the transition nozzle including a liner defining a combustion chamber therein and a wrapper circumscribing the liner such that a cooling duct is defined between the wrapper and the liner;

coupling a cooling fluid source in flow communication with a cooling fluid inlet that supplies a cooling fluid to the cooling duct;

coupling the cooling duct in flow communication with a cooling fluid outlet that is defined in the wrapper and receives cooling fluid discharged from the cooling duct, the cooling fluid outlet configured to direct a flow of the cooling fluid out of the cooling duct;

coupling a rib between the liner and the wrapper;

extending the rib completely around the combustion chamber such that a pair of axially-spaced cooling channels are defined in the cooling duct, wherein the pair of axially-spaced cooling channels include a first cooling channel and a second cooling channel that each circumscribe the combustion chamber such that the rib separates the first cooling channel from the second cooling channel; and defining a flow communication port in the rib that enables cooling fluid to flow from the first cooling channel into the second cooling channel through the flow communication port prior to being discharged into the cooling fluid outlet.

2. A method in accordance with claim 1, wherein coupling a cooling fluid source comprises coupling the cooling fluid source in flow communication with the cooling fluid inlet which is defined in the wrapper.

3. A method in accordance with claim 1, further comprising forming a cooling aperture in the liner to provide flow communication between the cooling duct and the combustion chamber.

4. A transition nozzle for use with a turbine assembly, said transition nozzle comprising:

a liner defining a combustion chamber therein;

a wrapper circumscribing said liner such that a cooling duct is defined between said wrapper and said liner;

a cooling fluid inlet that supplies a cooling fluid to said cooling duct;

a cooling fluid outlet that is defined in said wrapper and receives cooling fluid discharged from said cooling duct, said cooling fluid outlet configured to direct a flow of the cooling fluid out of said cooling duct;

a rib coupled between said liner and said wrapper, said rib circumscribing said combustion chamber such that a pair of axially-spaced cooling channels are defined in said cooling duct, said pair of axially-spaced cooling channels comprise a first cooling channel and a second cooling channel that each circumscribe said combustion chamber such that said rib separates said first cooling channel from said second cooling channel; and a flow communication port defined in said rib that enables cooling fluid to flow from said first cooling channel into said second cooling channel through said flow communication port prior to being discharged into said cooling fluid outlet.

5. A transition nozzle in accordance with claim 4, wherein said cooling fluid inlet is defined in said wrapper.

6. A transition nozzle in accordance with claim 4, further comprising a cooling aperture defined in said liner, said cooling aperture providing flow communication between said cooling duct and said combustion chamber.

7. A transition nozzle in accordance with claim 4, wherein said cooling fluid inlet is configured to supply steam as the cooling fluid.

8. A turbine assembly comprising:

a fuel nozzle that mixes fuel and air to create a fuel and air mixture; and a transition nozzle oriented to receive the fuel and air mixture from said fuel nozzle, said transition nozzle comprising:

a liner defining a combustion chamber therein;

a wrapper circumscribing said liner such that a cooling duct is defined between said wrapper and said liner;

a cooling fluid inlet that supplies a cooling fluid to said cooling duct;

a cooling fluid outlet that is defined in said wrapper and receives cooling fluid discharged from said cooling duct, said cooling fluid outlet configured to direct a flow of the cooling fluid out of said cooling duct;

a rib coupled between said liner and said wrapper, said rib circumscribing said combustion chamber such that a pair of axially-spaced cooling channels are defined in said cooling duct, said pair of axially-spaced cooling channels comprise a first cooling channel and a second cooling channel that each circumscribe said combustion chamber such that said rib separates said first cooling channel from said second cooling channel; and a flow communication port defined in said rib that enables cooling fluid to flow from said first cooling channel into said second cooling channel through said flow communication port prior to being discharged into said cooling fluid outlet.

9. A turbine assembly in accordance with claim 8, wherein said cooling fluid inlet is defined in said wrapper.

10. A turbine assembly in accordance with claim 8, further comprising a cooling aperture defined in said liner, said cooling aperture providing flow communication between said cooling duct and said combustion chamber.

11. A turbine assembly in accordance with claim 8, wherein said cooling fluid inlet is configured to supply steam as the cooling fluid.

* * * * *